United States Patent [19]

Braun et al.

[11] Patent Number: 4,759,485

[45] Date of Patent: Jul. 26, 1988

[54] APPARATUS FOR ADVANCING STRIP IN ROLLING MILLS

[75] Inventors: Martin Braun, Kreuztal; Crispin Bujok, Hilchenbach, both of Fed. Rep. of Germany

[73] Assignee: SMS Schloemann-Siemag AG, Dusseldorf, Fed. Rep. of Germany

[21] Appl. No.: 834,628

[22] Filed: Feb. 27, 1986

[30] Foreign Application Priority Data

Mar. 1, 1985 [DE] Fed. Rep. of Germany ..... 3507251

[51] Int. Cl.[4] ..... B21C 47/06

[52] U.S. Cl. ..... 226/176; 226/186; 72/245

[58] Field of Search ..... 226/89, 90, 174, 176, 226/180, 186; 72/245, 248, 166, 171

[56] References Cited

U.S. PATENT DOCUMENTS 3,477,268 11/1969 Schoffmann ..... 72/245 X
3,583,195 6/1971 Sherwood ..... 72/245 X
3,828,599 8/1974 Withrow ..... 72/245 X
4,223,719 9/1980 Riederer et al. ..... 72/245 X
4,614,099 9/1986 Coulter ..... 72/245 X

*Primary Examiner*—David Werner
*Attorney, Agent, or Firm*—Herbert Dubno; Andrew M. Wilford

[57] ABSTRACT

The drive apparatus is for rolling mills, especially for those which are subjecting the strip to a heat treating operation in wide-strip rolling-mill trains. The lower drive roll is mounted in the frame, and with reference to the upper drive roll which is connected to the swing arm, so as to be capable of performing adjusting and swinging movements. The respective housings of the lower drive roll are connected to hydraulically operated swing cylinders and position indicator devices. When the pressure control is operative the contact force at the rolls is a function of the prevailing hydraulic pressure. The apparatus also allows automatic zeroing of the drive roll gap.

12 Claims, 3 Drawing Sheets

APPARATUS FOR ADVANCING STRIP IN ROLLING MILLS

FIELD OF THE INVENTION

Our present invention relates to an apparatus having driving rolls for advancing strip, e.g. steel strip, in rolling mills, wide-strip rolling lines and the like, especially for strip coilers.

BACKGROUND OF THE INVENTION

A strip coiler of a rolling-mill line can be associated with an apparatus including at least two drive or driving rolls for advancing the sheet or strip to the coiler. The apparatus or assembly is particularly intended for hot-rolled strip or strip which is to be heated in the coil and wherein the heated strip is wound by a coiler upon a mandrel.

At least two drive rolls are provided, and these are arranged in parallel and superimposed manner in the stand. The apparatus is also equipped for control of the gap (nip) between the two drive rolls.

The upper drive roll can be connected, via its journal housings, to a swing arm which is associated with cylinders, i.e. piston and cylinder assemblies, which are operated by a pressure medium. These cylinders can serve to adjust the contact pressure or operating force of the rolls. The respective journal housings are held independently of one another at the swing arm, and generally parallel with respect to the direction of movement of this swing arm.

In the hitherto known apparatus for driving or advancing rolled strip or similar product in rolling mills, the upper drive roll is journaled in guides of the respective swing arm, and it can perform floating or similar adjusting movements. The lower drive roll is fixed in position relative to the frame structure, and it is generally disposed in a horizontally aligned attitude.

The relative position of the upper drive roll is determined by two cylinders, i.e. piston and cylinder assemblies, operated with pneumatic pressure. One cylinder is arranged on the drive side of the rolling mill and the other cylinder is provided on the operator's or operating (service) side of the stand of the strip feeder. The cylinders serve to support the upper drive roll such that its central longitudinal axis can be freely adjusted with reference to the strip of material being worked with. These pneumatic cylinders are referred to as control cylinders in the art, and their pressure characteristics can be varied in a smooth and stepless manner.

When the control cylinders are operated with a medium other than compressed air, the minimum contact or operating force is equal to the weight of the upper drive roll. However, it is less when the gap between the drive rolls is of such a magnitude that on initial feeding of strip into the gap only a part of the elastic deflection of the swing arm and of the drive rolls is eliminated in the system.

Especially in the case of thin strip, control of the gap is difficult because minor thickness variations of the strip and other factors can substantially affect the magnitude of the operating or contact pressure. However, based on experience, relatively thin strip needs to be coiled using a low contact pressure to ensure that the strip runs straight.

The operation of the known drive roll apparatus is usually such that the upper drive roll is lifted on introduction of the strip into the gap between the two rolls, and the central longitudinal axis of the upper roll can be freely adjusted or controlled with reference to the strip.

Different friction conditions may prevail at each side, i.e. drive side and service side as mentioned, of the rolling mill at the guide points of the upper roll and the pneumatic cylinders, which can lead to skewing of the upper drive roll on lifting it for initiating strip introduction, and the desired attitude with reference to the strip may not be achieved. This, in turn, may result in an improper course for the strip, i.e. a course which is not straight. A further problem in the known drive roll apparatus is that with reference to the characteristic of the contact force and drive-roll gap, a distance corresponding in magnitude to the play or clearance of the journals of the upper roll must be traversed should the contact force be greater than the weight of the drive roll.

The apparatus described in German Patent Publication (DE-OS) No. 26 14 254 is intended for rolled strip feed, and more particularly for coilers in wide-strip rolling-mill trains. The apparatus includes two drive rolls which are positioned in parallel and superimposed arrangement. The two rolls are adjusted with respect to one another, for preparatory adjustment to various strip thicknesses, to the respective gap distance, by way of a threaded spindle roll height controller.

The upper drive roll is journaled in a swing arm, and the journal housings of this drive roll are held at this arm, but they are independently arranged with respect to one another in such a way that they can be repositioned to carry out the journal functions. The lower or bottom roll, in turn, is guided and journaled by way of balancing devices in the frame, or in the stand.

OBJECTS OF THE INVENTION

It is the principal object of our present invention to provide an advancing apparatus for strip and the like products in rolling mills which precludes the drawbacks of the prior art apparatus.

It is also an object of our invention to provide an apparatus which is particularly adapted to advance heat treated strip material.

It is further an object of the invention to provide an apparatus which allows precise control of the course of the strip that is being processed.

It is yet another object of the invention to provide an apparatus which allows easy adjustment of the upper drive roll when feeding the strip into the gap between the upper and lower drive rolls.

SUMMARY OF THE INVENTION

These and other objects are attained in accordance with our invention in that with respect to the upper drive roll, which is mounted at the swing arm, the lower drive roll is journaled in the frame so as to be capable of being adjusted, moved, and rocked.

In accordance with a further aspect of the invention, the housings of the bearings or journals for the lower drive roll are connected to (a) rocker cylinders, i.e. cylinder and piston assemblies which are operated by a hydraulic pressure medium and, which are adapted to be actuated independently of one another in an approximately vertical direction, and are connected to (b) position control or indicating means.

Mounting of the lower drive roll in the frame so that it is capable of being adjusted, moved, and rocked (i.e. tilted by raising one end relative to the other) provides the advantageous option of lifting the lower drive roll at one end by a small amount for correcting or similarly influencing the course or path of the strip that is being processed. The magnitude of the displacement is monitored by the position indicator and the movement, say a swinging movement, of the swing arm is controlled as a function of the measured value.

By the approximate horizontal positioning of the hydraulic swing cylinders acting on the journal housings associated with the lower roll, in accordance with a further embodiment of the invention, the journals or bearings in the frame can be pressed against that guide surface at which the journals are in contact once the path of strip has been established between the core or mandrel of the coiler and the drive apparatus. The attendant play or clearance between a respective housing and the frame or stand, which can detrimentally affect the position and, accordingly, the course of the strip, are advantageously precluded by this invention.

In accordance with another embodiment of the invention, the upper drive roll is connected to the swing arm by way of control cylinders, i.e. cylinder and piston assemblies which are hydraulically operated. It is also preferred that the control cylinders cooperate with or include indicator means adapted to indicate a predetermined pressure level.

The indicator means which show the predetermined pressure level are advantageously used to establish a value corresponding to the pressure prevailing in the hydraulic cylinder and to bring the contact pressure at the rolls to the optimum value.

It is also within the scope of this invention to arrange balancing cylinders, i.e. cylinder and piston assemblies which are hydraulically operated, at the swing arm, which balancing cylinders are connected by way of their own journal housings at the upper drive roll.

The hydraulic balancing cylinders serve to equalize the mass of the upper drive roll in such a way that the pressure of the hydraulic control cylinders effectively acts in the direction of force of the contact pressure for the rolls. This is achieved substantially independently of the prevailing clearance or play of the journals, and substantially continuously.

In order to be capable of influencing the respectively required hydraulic pressure for balancing of the upper roll, in accordance with a further embodiment of the invention, the balancing cylinders are equipped with pressure sensors or indicators.

In accordance with yet another embodiment, the position of the respective journal or bearing housings for the upper drive roll, and thereby the adjustment of the roll gap, can be determined by way of position sensors or indicators which are arranged at the swing arm.

DESCRIPTION OF THE DRAWING

The above and other objects, features and advantages of our invention will become more readily apparent from the following description, reference being made to the accompanying drawing in which.

SPECIFIC DESCRIPTION

Figure 1:
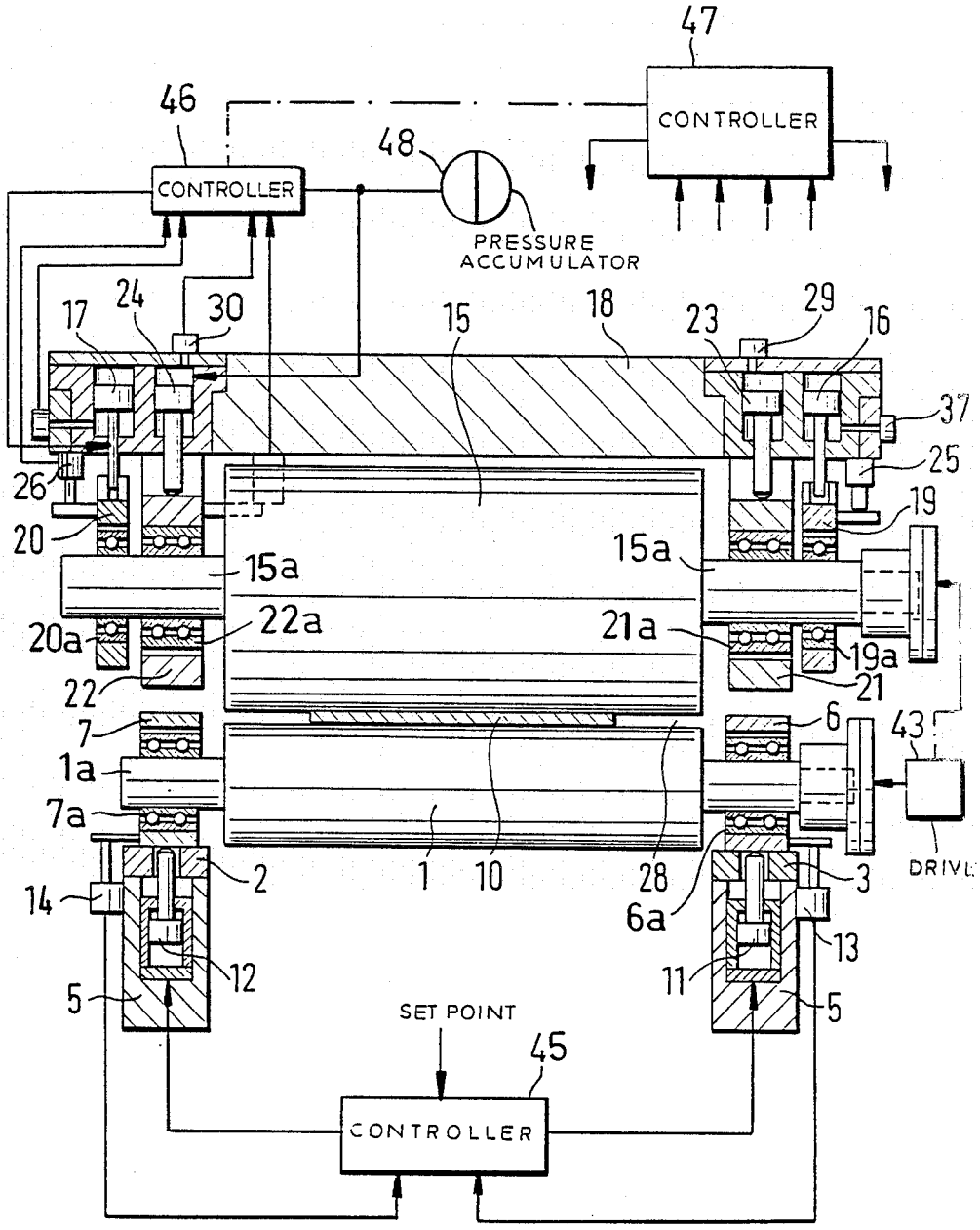
FIG. 1 is a cross-sectional view of the apparatus in the direction transverse to the strip processed in it.
Figure 2:
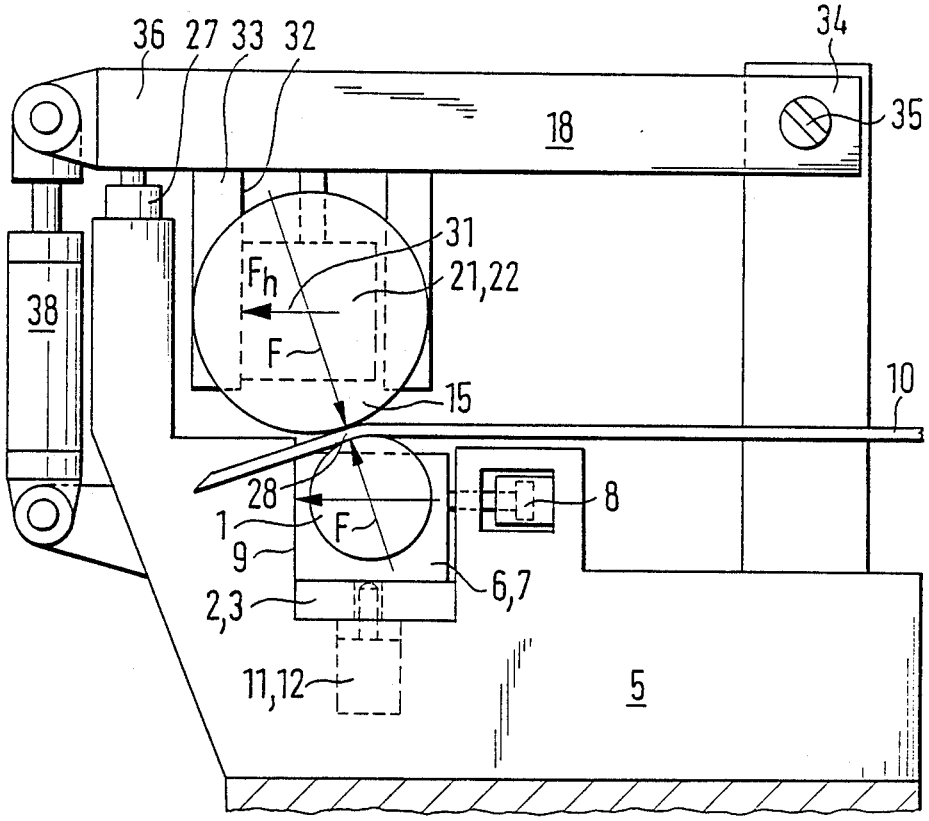
FIG. 2 is a side elevational view of the apparatus according to FIG. 1.
Figure 3:
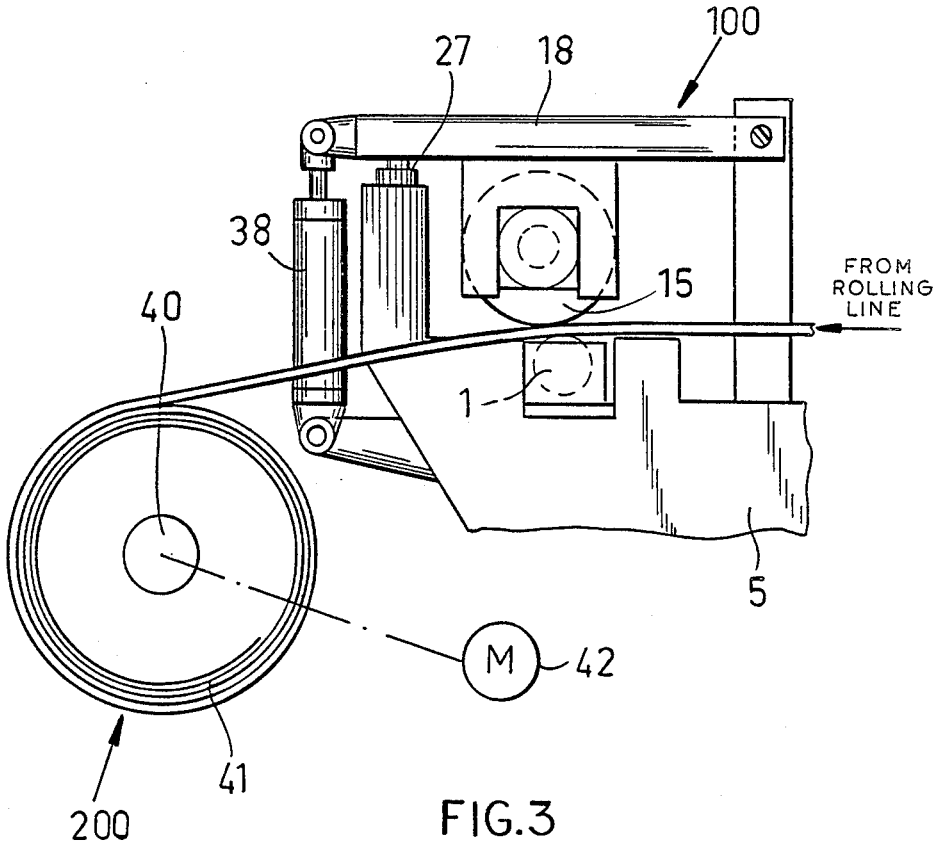
FIG. 3 is a diagram showing how the strip feeder of the invention is associated with a coiler.

As can be seen from FIG. 3, the strip feeder 100, described in greater detail with reference to FIGS. 1 and 2, is associated with a coiler 200 of any conventional design common in rolling mill lines or trains and comprising a mandrel or core 40 on which the coil 41 is wound as the mandrel is driven by a motor 42 which can be associated with the drive 43 of the feeder.

As is clearly evident in FIGS. 1 and 2, the lower drive roll 1 is arranged, when in the normal position or condition, to rest by its journals on the left support piece 2 and on the right support piece 3. The two support pieces 2 and 3 of the stand ensure the accurate horizontal positioning of the lower drive roll 1.

The frame 5 of the stand is shown only diagrammatically, but receives the bearing or journal housings 6 and 7, or directly mounts the bearings **6*a* and 7*a* for the axle or shaft portions 1*a* of the lower drive roll 1**.

The housings 6 and 7 are split elements which allow easier installation in the receiving pockets of the frame 5. The housings 6 and 7 are secured, in order not to affect through relative movement the lower drive roll 1, by cylinders 8, i.e. cylinder and piston assemblies operated by hydraulic pressure. The hydraulic cylinders 8 are arranged at the frame or base 5. The cylinders 8 act in approximately horizontal direction (see particularly FIG. 2), and each one of the housings 6 and 7 is pressed against a corresponding guide surface 9 by a respective hydraulic cylinder 8. When the strip 10 has bridged the distance between the drive apparatus and the core or mandrel of the coiler, the housings 6 and 7 are brought into contact with the guide surface 9.

When uneven coiling of the strip 10 is observed or determined, for example in the event of a sabre-shaped or similarly curved strip, one can advantageously lift the lower roll 1 by a small amount and at one side only, as desired, in order to control the course of the strip 10. Thus, one can correct attendant deviations of the strip 10. Lifting is done by way of independently actuated rocker cylinders 11 and 12, i.e. cylinder and piston assemblies operated by hydraulic pressure, respectively arranged at the drive side or the operator's side of the rolling mill.

The rocker movement is measured by the position indicators or similar sensor devices 13 and 14, and movement of the drive roll 1 is controlled in conformity with the observed value by way of the hydraulic swing cylinders 11 and 12. The two cylinders 11 and 12 are respectively equipped with a position control device 45 in accordance with servocontrol principles.

The mass of the upper drive roll 15 is balanced by way of two cylinders 16 and 17, i.e. cylinder and piston assemblies operated by hydraulic pressure, arranged generally laterally at the swing arm 18. The cylinders 16 and 17 are respectively connected by way of housings 19 and 20 at the upper drive roll 15, specifically at the mounting axles or shafts **15*a* thereof, and corresponding bearings 19*a* and 20*a***.

The clearance or play in the journal of the respective drive roll is eliminated by a corresponding displacement, which is directed in the direction of force of the contact pressure, of the hydraulic balancing cylinders 16 and 17, and these have to be operated so as to provide an excess of balancing action. By way of this balancing, one can equilibrate, independently of the operating range of the driver, the position of the housings 19 and 20 as well as the position of the housings 21 and 22.

The housings 21 and 22 are connected at control cylinders 23 and 24, i.e. cylinder and piston assemblies operated by hydraulic pressure, also arranged at the swing arm 18. The housings 21 and 22 are for respective bearings 21*a* and 22*a* at the mounting axles 15*a* of the upper drive roll 15.

Thus, it is feasible to determine very precisely the position of the upper drive roll 15 with respect to the position of the swing arm 18, and this is done by the position indicators 25 and 26 also arranged at the swing arm 18.

The swing arm 18 can rest on fixed supports 27 (FIG. 2) of the frame 5 so that the position indicators 25 and 26 will show the exact magnitude of the roll gap 28 between the two drive rolls, i.e. lower drive roll 1 and upper drive roll 15.

During the operation of the drive apparatus in accordance with the invention, the contact pressure, or operating force of the two drive rolls 1 and 15 is controlled via a predetermined pressure, which is monitored by the pressure indicators 29 and 30 at the hydraulic control cylinders 23 and 24. These two hydraulic control cylinders 23 and 24, operated by the gauged controllers 46,47, also cooperate with the position indicators 25 and 26 for adjustment of the gap 28, and this affords a very accurate position control of the upper drive roll 15.

On initial introduction of the strip 10 into the drive apparatus the height of the gap 28 must be less than the thickness of the strip 10 so that a proper contact pressure can gradually be established. In order to preclude pressure surges in the gap 28, it is preferred that the hydraulic system include hydraulic accumulators 48, only one of which has been shown.

Upon introduction of the strip 10 into the gap 28, the hydraulic control cylinders 23 and 24, which are equipped with individual pressure indicators 29 and 30 and pressure control devices 46,47 are operated in the pressure control mode. By way of these pressure control modes and utilizing distinct pressure actuation for the two hydraulic control cylinders 23 and 24 adjustment of the course of the strip 10 is readily achieved. Just prior to exiting of the strip end, the pressure control mode can be replaced by the position control mode.

The signals of the two pressure indicators 29 and 30 are employed to generate the desired contact pressure at the drive side and operator's side of the drive rolls 1 and 15.

As can be best understood with reference to FIG. 2, the housings 21 and 22 of the upper roll 15 are pressed against the side or wall 32 of the housing guide 33, which is effected by the horizontal component $F_h$, indicated by the arrow identified by the reference numeral 31, of the contact force F as well as by the pulling force exerted by the strip 10 between the coiler and the drive apparatus.

Thus in any case a precisely defined position of the housings 21 and 22, and accordingly the precise position of the upper roll 15, can be ensured.

Use of a separate hydraulic clamping cylinder is not required for the upper drive roll 15.

The swing arm 18 for the upper roll 15 is mounted at its end 34 by way of antifriction bearings 35 so as to be able to carry out its swinging or arcuate movement about this pivot point. The free end 36 of the swing arm 18, in turn, is supported on the fixed supports or contact-supports 27 at the frame or base 5, as mentioned. The horizontal adjustment of the swing arm 18 can be carried out during the initial installation of the swing arm 18 by a precise dimensioning and alignment of the supports 27, and this remains substantially constant. Since the arm 18 bears against the rests 27 which are fixed to the stand, the position indicators 25, 26 accurately indicate the nip width.

For accurate pulling of the strip during winding or coiling, the drive apparatus in accordance with the invention, in comparison to the known apparatus, provides advantageously for adjustment or control with a larger differential between the roll gap width and the thickness of the strip, because the upper drive roll 15 can be lifted for introduction of the strip 10 into the gap 28, and generation of an undesirably high contact pressure is prevented. The contact pressure can be precisely controlled by way of the pressure control options of the control cylinders 23 and 24, and the course of the strip can be precisely corrected.

As well, the free end 36 of the swing arm 18 is articulated to hydraulic or pneumatic cylinders 38 which are pivotally connected to the frame 5, and by these cylinders the swing arm 18 and the upper drive roll 15 connected to it can be raised and lowered as desired, e.g. for insertion of the leading edge of the strip.

The drive apparatus in accordance with the invention, accordingly, affords an optimal control with respect to the course of the strip, and particularly in the case of coilers for thin strip which is subjected to heat treatment.

The drive apparatus allows substantially automatic zeroing. For this, the drive rolls 1 and 15 can be moved towards one another, and the position of the upper roll 15—on contacting the lower drive roll 1—can be registered by way of changes in the pressure signals at the pressure indicators 29, 30 and 37.

A particular advantage of the invention resides therein that the apparatus can be installed at any time and in existing equipment by subsequent assembly or retrofitting.

In summary it may be stated that in the known drive apparatus for rolled strip and the like, especially those which are subjected to a heat treating operation in wide-strip rolling-mill trains, the upper roll is floatingly mounted in guides of the swing arm. The lower roll, in turn, is fixed in the horizontal position in respective journals. The upper roll is lowered by way of hydraulic cylinders arranged on the drive side and the operator's side of the rolling mill, or by gravity, whereby the position of the central longitudinal axis can be freely aligned with reference to the strip.

Frictional differences experienced on the drive side and the operator's side in the guides of the upper roll and the pneumatic cylinders, however, can lead to a skewing or undesirable inclination of the drive roll during operation, and the drive may not assume the position which is desired for the strip that is being worked on. This may lead to an undesirably deviating course of the strip. As well, the play or clearance of the respective journals for the drive rolls can detrimentally affect the guiding and the course or direction of run of the strip. In accordance with one aspect of the invention these disadvantages are precluded thereby that the lower drive roll 1 is mounted in the frame 5, and with reference to the upper drive roll 15 which is connected to the swing arm 18, so as to be capable of performing adjustable and swinging movements, and that the respective journal housings of the lower drive roll are connected to (a) hydraulic swinging cylinder and (b) position indicator means.

When the pressure control is operative, the contact force at the rolls is not dependent on the magnitude of the difference of strip thickness and roll gap, but by the prevailing hydraulic pressure. The apparatus also allows a substantially automatic zeroing of the drive roll gap.

We claim:

1. A strip feeder for a strip coiler in a rolling-mill line for producing hot-rolled strip, the strip feeder comprising:

a drive stand;

an upper drive roll mounted in said stand;

a swingable arm pivotally connected to said stand at one side of said upper drive roll and braced against said stand on an opposite side of said upper drive roll;

a pair of support cylinders and respective support bearings supporting the upper roll on the arm;

respective pressure sensors associated with the support cylinders;

a pair of balancing cylinders and respective balancing bearings separate from the support bearings supporting the weight of the upper roll on the arm;

a lower drive roll juxtaposed with said upper drive roll and defining a nip therewith through which said strip is fed;

respective bearing blocks at each end of said lower drive roll rotatably journaling same on said stand and received with horizontal play in said stand and with at least limited freedom of vertical movement therein;

respective hydraulic cylinders operatively connected with said blocks for rocking said lower roll by vertically displacing said blocks and thereby compensating for deviation in the path of said strip through said feeder; and respective position sensors operatively connected with said blocks and controlling said cylinders.

2. The strip feeder defined in claim 1, further comprising respective horizontally effective cylinders in said stand acting on said blocks to press the same against surfaces of said stand in the direction of said coiler.

3. The strip feeder defined in claim 1, wherein said balancing cylinders are provided with respective pressure sensors.

4. The strip feeder defined in claim 1, wherein said upper roll is provided with position sensors indicating the width of said nip.

5. A strip driver for advancing rolled strip, especially hot-rolled strip, in a rolling mill to a coiler, said strip drive comprising:

a frame;

a lower drive roll centered on a horizontal lower rotation axis;

a pair of axially spaced journal blocks carrying said lower drive roll and mounted in said frame for independent substantially linear movement in a substantially vertical direction and independent substantially linear movement in a substantially horizontal direction relative to said frame and transverse to the lower axis;

a respective pair of upright hydraulic rocker cylinders on said frame respectively acting upon said journal blocks and independently capable of displacing same in said substantially vertical direction;

a respective pair of generally horizontal actuating cylinders on said frame respectively acting upon said journal blocks for displacing same in said substantially horizontal direction;

a respective pair of position sensors mounted to respond to the positions of said journal blocks relative to the frame;

a swing arm having a free end above the lower drive roll and pivotally mounted at an opposite end on said frame for performing a swinging movement about a horizontal axis offset horizontally from the roll axes;

an upper drive roll located above and juxtaposed with said lower drive roll and centered on an upper rotation axis generally parallel to and spaced above the lower axis so as to define with the lower roll a gap through which said strip passes;

a pair of axially spaced upper roll journal blocks journaling said upper roll on said swing arm close to the free end of said arm and remote from the arm axis so that said upper roll is substantially parallel to said lower roll, said upper roll journal blocks being independently shiftable on said swing arm in a substantially vertical direction transverse to the upper-roll axis;

hydraulic means between said free end of said arm and said frame for lifting said arm and the upper roll for permitting insertion of strip between said rolls;

a respective adjustment cylinder between each of said upper roll journal blocks and said swing arm for adjustment of a contact force with which said rolls bear upon said strip; and control means connected to the position sensors and to the rocker cylinders for independently pressurizing each rocker cylinder independently of the other rocker cylinder in accordance with the outputs of the respective sensors and thereby skewing the lower axis relative to the upper axis.

6. The strip driver defined in claim 5 wherein said adjustment cylinders include hydraulically operated control cylinders operatively extending between a respective end of the upper drive roll and said swing arm for control of the desired roll gap.

7. The strip driver defined in claim 6 further including indicator devices for monitoring the prevailing hydraulic pressure level, with a respective indicator device being connected to a respective hydraulic control cylinder.

8. The strip driver defined in claim 5 further comprising balancing journals connected at the mounting axle portion of said upper drive roller, and wherein said adjustment cylinders include hydraulically operated balancing cylinders operatively connected at a respective balancing journal and said swing arm for control of the play of at least one journal.

9. The strip driver defined in claim 8 further including indicator devices for monitoring the prevailing hydraulic pressure level, with a respective indicator device being connected to a respective hydraulic balancing cylinder.

10. The strip driver defined in claim 5 further comprising position indicators for the determination of the position of the respective journal housings for said upper drive roll and the adjustment of the roll gap, said position indicators being operatively secured at said swing arm.

11. The strip driver defined in claim 5 further comprising at least one fixed contact-support secured on said frame at said free end.

12. The strip driver defined in claim 11 wherein said swing arm is pivotally mounted by antifriction-type bearing means.

* * * * *